United States Patent [19]

Henley

[11] Patent Number: 4,498,462

[45] Date of Patent: Feb. 12, 1985

[54] FLUIDIZED BED THERAPY APPARATUS

[76] Inventor: Ernest J. Henley, 359 Westminister Dr., Houston, Tex. 77024

[21] Appl. No.: 318,376

[22] Filed: Nov. 5, 1981

[51] Int. Cl.[3] ..... A61H 29/00

[52] U.S. Cl. ..... 128/24.1; 128/65; 128/38

[58] Field of Search ..... 128/1 B, 24.2, 24.1, 128/24 R, 38, 65, 66; 272/2

[56] References Cited

U.S. PATENT DOCUMENTS

| | | | |
|---|---|---|---|
| 2,956,565 | 10/1980 | Anderson | 128/65 X |
| 2,975,786 | 3/1961 | Williams | 128/65 |
| 3,643,941 | 2/1972 | Kashar | 272/2 |
| 3,760,800 | 9/1973 | Staffin et al. | 128/24.1 |
| 4,133,302 | 1/1979 | McGrath et al. | 128/1 B |
| 4,214,576 | 7/1980 | Henley | 128/24.1 |

*Primary Examiner*—Steven A. Bratlie
*Assistant Examiner*—David J. Brown

[57] ABSTRACT

An apparatus for therapeutic massage and therapy of body parts by immersion of the body parts in a fluidized solids bed.

10 Claims, 4 Drawing Figures

FLUIDIZED BED THERAPY APPARATUS

CROSS REFERENCE TO RELATED PATENTS

This application relates to improvements in the apparatus and method disclosed in U.S. Pat. No. 3,760,800 issued Sept. 25, 1973 and U.S. Pat. No. 4,214,576 issued July 29, 1980.

BACKGROUND OF THE INVENTION

As used in this application, the term "Fluidotherapy unit" means apparatus for applying massage and heat or cold to the arms, legs and other parts of the body, whether human or animals, using a fluidized solids bed as the heat transfer medium. The apparatus is arranged to position the member being treated in intimate heat conducting relation with a mass of finely divided solid particles by immersing the member in the mass. Meanwhile, the mass is rendered turbulent by forcing a gas, e.g. air, therethrough whereby the member is subjected to massaging action. The massaging action may or may not be accompanied by heat or cold imparted to the mass, e.g. by utilizing electrical heating elements or a refrigerant to heat or cool the body member, as the case may be.

Prior art patents disclose an early form of apparatus for providing massage by subjecting a body member to the massaging action ebullient, heated bed of particles.

SUMMARY OF THE INVENTION

The present invention is directed to an apparatus which is particularly adaptable for home care use, or use by contract therapists that require a unit which can be transported easily. It is designed for patients who require daily treatments and wish to rent a unit, as opposed to purchasing a unit, or patients with chronic problems who wish to purchase a unit for use on an "as needed" basis. To accomplish this, the unit is relatively compact and includes the most simple of controls for operating the device. Heat to the fluidized bed is supplied by compression of the fluidizing air or gas. There is no heating unit, per se, used.

DESCRIPTION OF THE PREFERRED EMBODIMENTS

Figure 1:
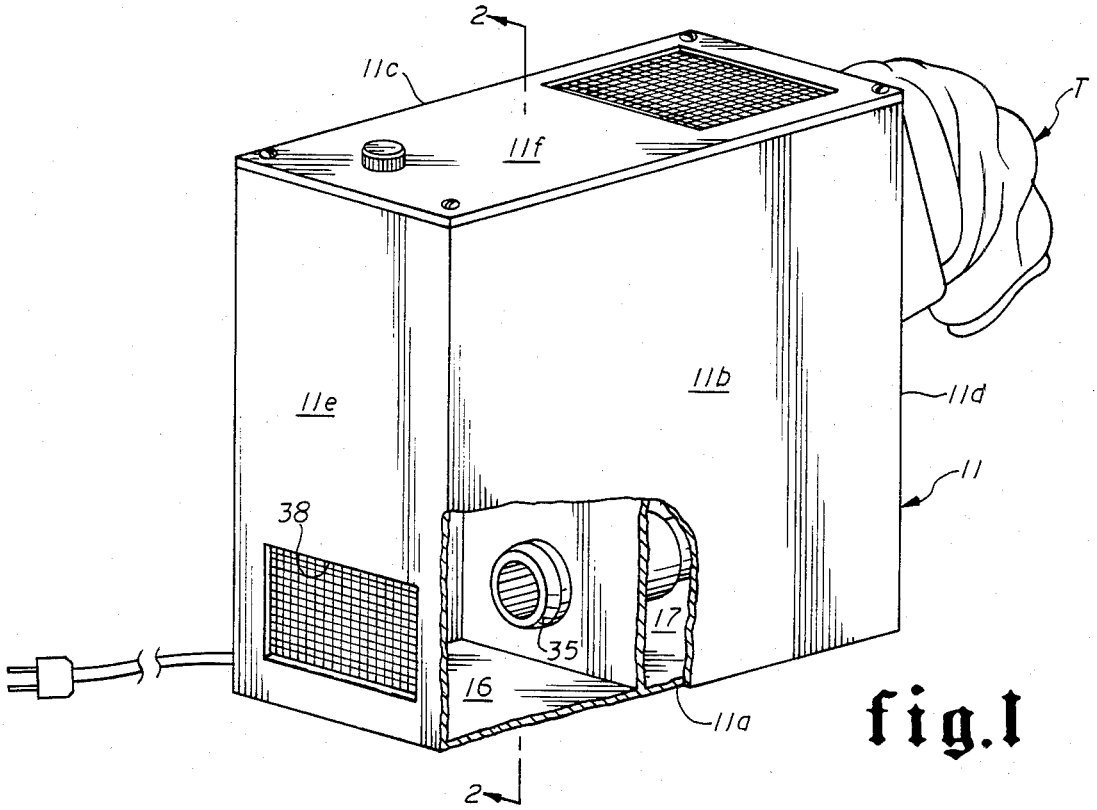
FIG. 1 is a perspective view, partly cut away, illustrating one embodiment of the present invention.

Attention is first directed to FIG. 1 of the drawings wherein a cabinet 11 is shown which may be formed of sheet steel or a laminated composition or any other suitable material and comprising a bottom wall 11*a*, side walls 11*b*, 11*c*, end walls 11*d*, 11*e* and a top wall 11*f*.

Figure 2:
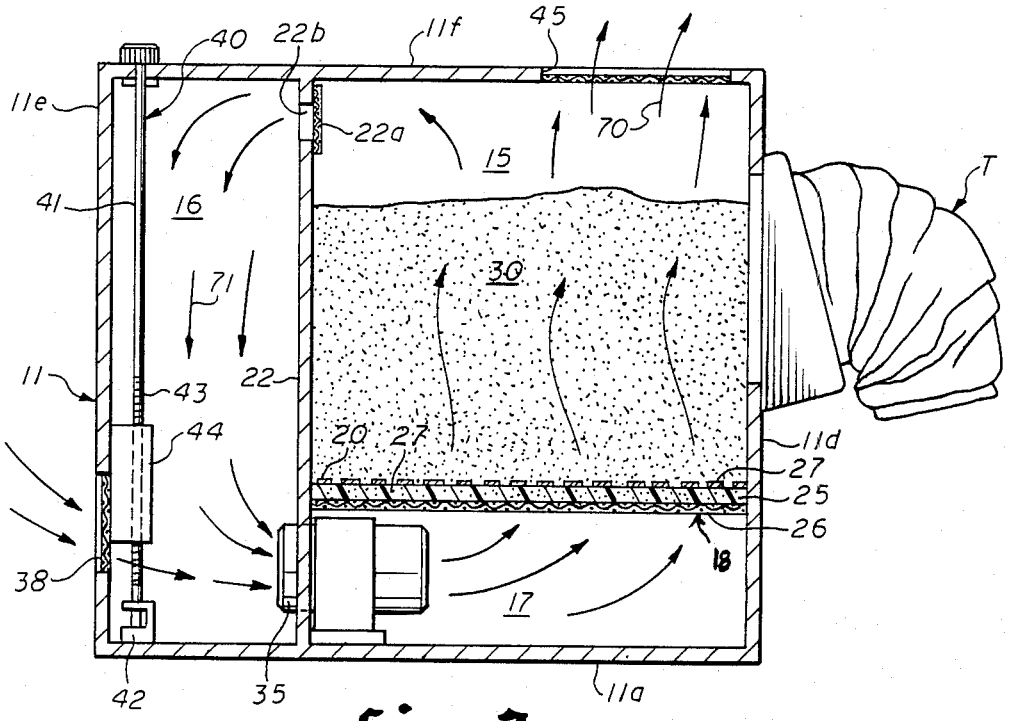
FIG. 2 is a sectional view on the line 2—2 of FIG. 1 illustrating further details of the present invention.
Figure 3:
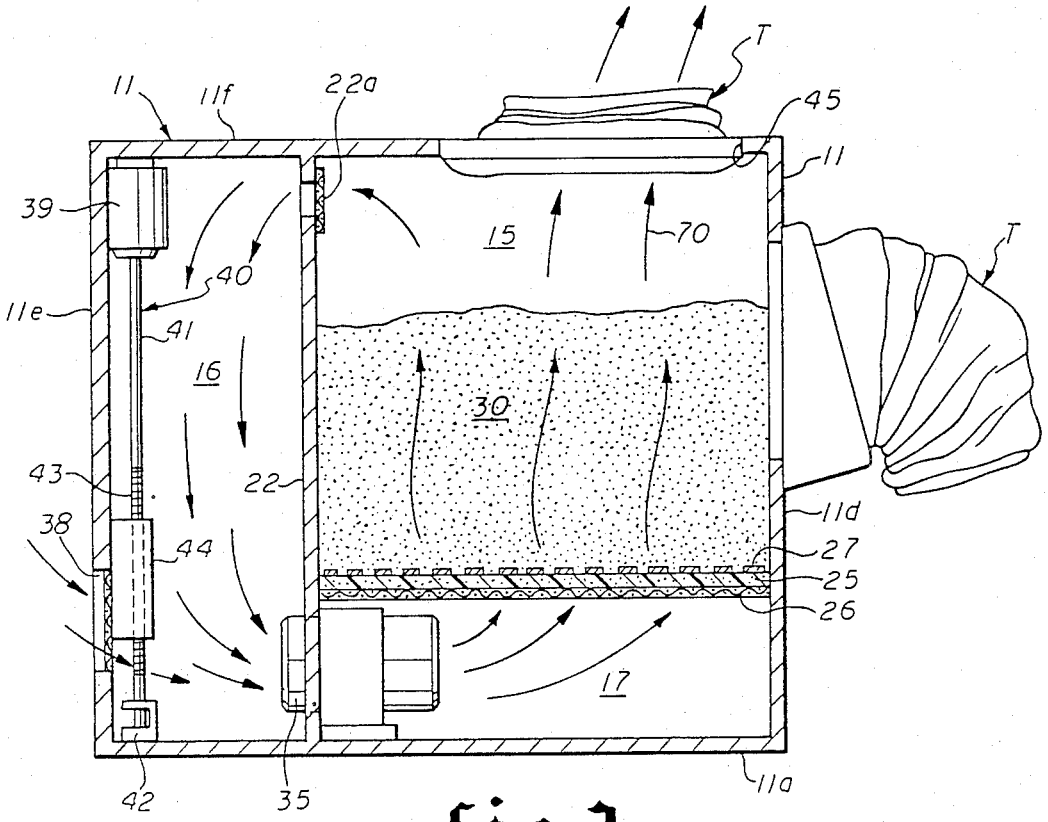
FIG. 3 is a sectional view similar to FIG. 1 illustrating the present invention with a side sleeve means or tubular member as well as a top entry sleeve means or tubular member.

In one sense, the cabinet may be considered as being divided into three chambers represented at 15, 16 and 17 in FIGS. 2 and 3 formed by first wall means 18 which is spaced from the cabinet bottom wall 11*a* and extends from one cabinet end wall 11*d* between the cabinet side walls 11*b*, 11*c* to terminate at a position as illustrated at 20 in the drawings which is spaced from the other cabinet end wall means 11*e*.

Second wall means 22 extends between the cabinet side walls 11*b*, 11*c* and parallel to the cabinet end walls 11*e*, 11*d* and also extends from the cabinet bottom wall means 11*a* to the cabinet top wall means 11*f* as illustrated. The second wall means 22 is provided with an orifice 22*a* which is positioned above the highest level of the mass of particles 30 when in a turbulent state for recycling gas from the chamber 15 to the chamber 16 and back to the chamber 17 beneath the chamber 15 to conduct it through the polyurethane open cell foam material. The orifice 22*a* is provided with a filter cloth or screen 22*b* to assist in retaining particles 30 within chamber 15.

The first wall means 18 may be formed of any suitable material which permits gas to pass therethrough and which functions to distribute the gas as well as create a pressure drop. This material may be termed a distributor. Open cell foam material as represented at 25 serves this purpose quite well which may be supported on the screen 26 and if necessary held in position by the grating 27 secured in any suitable manner, not shown, to the wall means 11*d* and second wall means 22.

A mass of solid particles 30 is supported on the distributor such as polyurethane open cell foam material to constitute a bed in which the body part may be immersed.

Means such as the compressor referred to at 35 are provided to force gas from chamber 16 to chamber 17 and then upwardly through the first wall means 18 including the screen 26, polyurethane open cell material 25 and grating retainer 27. The compressor 35 may be of any suitable type, and it has been found that an ordinary vacuum cleaner unit or blower serves the function quite well.

In FIGS. 1 and 2, a tubular or sleeve member referred to at T is secured to the end wall 11*d* of the cabinet 11 through which the body part may be passed into the mass for immersion therein.

It will be further noted that the fresh gas or air inlet opening 38 is provided in the other end wall 11*e* to enable fresh air to pass to the chamber 16 for circulation by the compressor unit 35 into the chamber 17 and then upwardly through the open cell foam bottom to create and maintain the mass 30 of solid particles in turbulent condition. Suitable means as illustrated at 40 are provided for controlling the amount of fresh air or gas permitted through the opening 38, such means being shown in FIGS. 1 and 2 as being manually operable by means of the knob on the end of rotatable rod 41. The rod 41 extends through the top 11*f* of the cabinet 11 and rests in the support 42 on bottom 11*a*. A portion 43 of the rod 40 is threaded as shown and threadedly engaged therewith is the cover plate 44 so that upon rotation of the rod 41, the cover plate 44 is moved upwardly or downwardly depending on the direction of rotation of rod 41 to open or close the opening 38 as desired.

Additionally, an access opening 45 is provided in the top 11*f* of the cabinet 11 as shown which may be used to discharge air from the chamber 15, or if desired, may be used to provide access for a body member to be treated in the mass 30 of particles through the top 11*f* of the cabinet 11. As illustrated in FIG. 3 of the drawings, a tubular member or sleeve member T is mounted over opening 25 whereby the body part may be inserted therethrough.

Also in FIG. 3, it will be noted that the adjustment means 40 for the opening 38 includes the rod 41 which is rotatably supported at its base in the support 42 on the bottom wall 11*a* in the cabinet as described with regard to FIG. 2 and is provided with a threaded portion 43 that threadedly engages the cover plate 44 of opening 38. In the modification shown in FIG. 3, the rod 41 is adapted to be rotated by the motor means 39 which is electrically connected (not shown) by any suitable means to a power source for rotation of the rod to regulate the amount of opening 38 exposed for entry of fresh air. Any suitable control means (not shown) to turn the motor 39 on and off may be provided.

Figure 4:
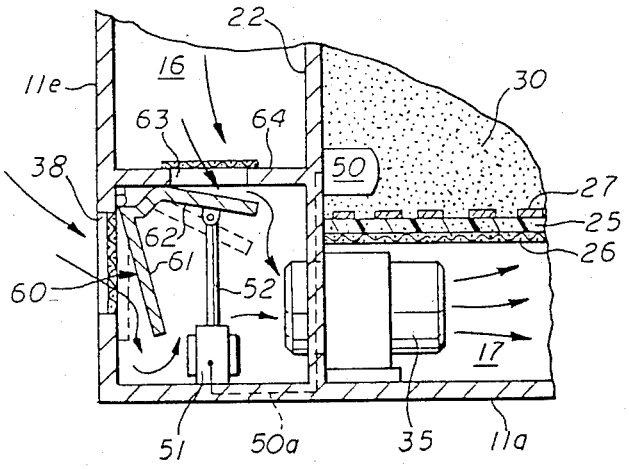
FIG. 4 illustrates an alternate arrangement for regulating the amount of fresh air or gas and recycled air or gas employed with the invention.

In FIG. 4, a thermostat 50 is represented as being mounted in the mass of particles 30 and electrically connected by any suitable means such as the electrical conduit 50*a* extending through the wall means 22 to the positioning servo or solenoid 51. The solenoid 51 includes the member 52 which is adapted to engage the valve means referred to generally at 60 and includes plate means 61 connected to plate means 62. The plate means 62 either opens, closes or restricts opening 63 in plate 64 extending across chamber 16, and plate means 61 likewise either opens, closes or resticts flow of fresh air through opening 38. Thus, the amount of fresh air through passage 38 as well as the amount of recirculated air from chamber 15 and chamber 16 to be conducted by the motor means 35 back through the bed or mass of material 30 may be adjusted in relation to the temperature of the mass of particles 30 as determined by thermostat 50. It can be appreciated that any suitable arrangement for adjusting the thermostat may be employed by positioning such adjustment on the cabinet 11 or by including an internal adjustment so that the thermostat 50 may be manually adjusted by rotation thereof within the bed 30.

Heat is generated by compressing gas as it passes through the compressor thus heating the gas or air as it is conducted through the compressor. The compressor means 35 then forces the air upwardly through the distributor and mass of particles 30 to maintain the bed of particles in turbulent motion in a manner well known in the art. The air is then discharged from the mass 30 as represented by the arrows 70 for subsequent discharge through the opening 45 with part of the air recirculating through the orifice 22*a*. The air is then recirculated through chamber 16 as illustrated by the arrows 71 and is sucked by the compressor 35 along with whatever fresh air is desired into the chamber 17 to be subsequently discharged through the distributor or material represented at 25.

I have discovered that an open cell foam material, such as polyurethane, is particularly suitable as a bottom for a fluidized bed. One advantage I have discovered is that a fluidized bed bottom formed of open cell foam material, such as polyurethane, forms a self-cleaning distributor in that it properly distributes the air or gas into and throughout the bed and encourages the creation of small gas bubbles to assist in creating and maintaining the mass of solid materials in a turbulent condition within the chamber 15 to form a fluidized bed of particles. Why the gas cleaning occurs with such material while also providing better distribution of the gas than heretofore possible is not known, nor is it known why it appears to function as a gas bubble generator for the gas as the gas is discharged into the mass 30.

When the unit is in operation, a hand or foot may be inserted through the tubular member T into the fluidized bed 30 for treatment in a manner well known for as long a period as desirable.

It is to be noted that the fluidizing gas or air employed with the present invention is not heated by a separate heater unit. Heat is imparted to such gas by compression thereof by compressor 35, which heat in turn is imparted to the fluidized bed 30.

The foregoing disclosure and description of the invention are illustrative and explanatory thereof, and various changes in the size, shape and materials as well as in the details of the illustrated construction may be made without departing from the spirit of the invention.

What is claimed is:

1. Apparatus for therapeutic massage of parts of the human body comprising:

a. a cabinet defined by top, bottom, side and end wall means;

b. means dividing said cabinet into three chambers, said means including:

1. first wall means spaced from said cabinet bottom wall means and extending between said cabinet side wall means from one of said cabinet end wall means and terminating at a position spaced from the other cabinet end wall means;
2. second wall means extending between said cabinet end wall means and from said cabinet bottom wall means to said cabinet top wall means; and
3. said first wall means being connected to said second wall means;

c. said first wall means being formed of material which permits gas to pass therethrough;

d. a mass of solid particles supported on said first wall means to constitute a bed in which the human body part may be immersed;

e. said second wall means having an orifice therein above the highest level of the mass when in a turbulent state for recycling gas to said open cell mass;

f. means to force gas upwardly through said first wall means to create and maintain an ebullient condition of the particles; and g. a tubular member through which the body part may be passed into the mass for immersion therein.

2. The apparatus of claim 1 including:

a. inlet fresh gas means in said other cabinet end wall means; and b. means to adjust the size of the inlet fresh gas means.

3. The apparatus of claim 2 wherein the means to adjust is manually operable.

4. The apparatus of claim 2 wherein the means to adjust includes:

a. thermostat means immersed in the mass;

b. means to control the amount of fresh gas and the amount of recycled gas forced through the particles; and c. means electrically connecting said thermostat to said valve means to control the proportion of fresh air to recycled air in relation to the temperature of the mass of particles.

5. The apparatus of claim 1 wherein said tubular member extends through said one end wall of said cabinet.

6. The apparatus of claim 1 wherein said tubular member extends through said cabinet top wall.

7. Apparatus for therapeutic massage of parts of the human body comprising:

a. a cabinet;

b. a chamber in said cabinet having a bottom wall and side walls together defining a space wherein said bottom wall forms a distributor, a mass of solid particles contained in said space to constitute a bed in which the body part may be immersed;

c. means to force gas upwardly through the distributor to create and maintain an ebullient condition of the particles;

d. a tubular member through which the body part may be passed for immersion in the bed;

e. means to conduct the gas from the chamber after it has passed through the mass of particles and recirculate it through said distributor;

f. conducting means to conduct fresh gas for circulation upwardly through the distributor; and g. means to regulate the amount of fresh gas received from said conducting means.

8. The apparatus of claim 7 wherein said means to conduct gas from the chamber includes orifice means.

9. The apparatus of claim 7 including means to regulate the amount of gas recirculated to said distributor and the amount of fresh gas circulated to said distributor.

10. The apparatus of claim 9 wherein the means to regulate includes:

a. thermostat means immersed in the mass;

b. valve means to control the amount of fresh gas and recycled gas forced through said open cell material; and c. means electrically connecting said thermostate to said valve means to control the proportion of fresh air to recycled air in relation to the temperature of the mass of particles.

* * * * *